US008151881B2

(12) United States Patent
Johnson et al.

(10) Patent No.: US 8,151,881 B2
(45) Date of Patent: Apr. 10, 2012

(54) PERMEABILITY FLOW BALANCING WITHIN INTEGRAL SCREEN JOINTS

(75) Inventors: Michael H. Johnson, Katy, TX (US); Namhyo Kim, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 205 days.

(21) Appl. No.: 12/476,865

(22) Filed: Jun. 2, 2009

(65) Prior Publication Data

US 2010/0300676 A1 Dec. 2, 2010

(51) Int. Cl.
*E21B 43/24* (2006.01)
*E21B 43/30* (2006.01)

(52) U.S. Cl. ..... 166/272.3; 166/245; 166/268

(58) Field of Classification Search ..... 166/268, 166/245, 272.3
See application file for complete search history.

(56) References Cited

U.S. PATENT DOCUMENTS

| | | | |
|---|---|---|---|
| 1,362,552 | A | 12/1920 | Alexander et al. |
| 1,488,753 | A | 4/1924 | Kelly |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,240,274 | A | 3/1966 | Solum |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,333,635 | A | 8/1967 | Crawford |
| 3,385,367 | A | 5/1968 | Kollsman |
| 3,386,508 | A | 6/1968 | Bielstein et al. |

(Continued)

FOREIGN PATENT DOCUMENTS

CN 1385594 12/2002

(Continued)

OTHER PUBLICATIONS

International Search Report and Written Opinion, Mailed Feb. 2, 2010, International Appln. No. PCT/US2009/049661, Written Opinion 7 Pages, International Search Report 3 Pages.

(Continued)

*Primary Examiner* — Giovanna Wright
(74) *Attorney, Agent, or Firm* — Cantor Colburn LLP

(57) ABSTRACT

A SAGD system in a formation including a heated fluid injection well having a tubular including permeability control, one or more open hole anchors restricting thermal growth of the tubular and one or more baffles directing heated fluid application to target areas of the formation; a production well in fluid collecting proximity to the injection well the production well having a tubular with permeability control, one or more open hole anchors and one or more baffles.

12 Claims, 3 Drawing Sheets

U.S. PATENT DOCUMENTS 3,419,089 A 12/1968 Venghiattis
3,451,477 A 6/1969 Kelley
3,468,375 A 9/1969 States
RE27,252 E 12/1971 Sklar et al.
3,675,714 A 7/1972 Thompson
3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,958,649 A 5/1976 Bull et al.
3,975,651 A 8/1976 Griffiths
4,153,757 A 5/1979 Clark, III
4,173,255 A 11/1979 Kramer
4,180,132 A 12/1979 Young
4,186,100 A 1/1980 Mott
4,187,909 A 2/1980 Erbstoesser
4,245,701 A 1/1981 Chambers
4,248,302 A 2/1981 Churchman
4,250,907 A 2/1981 Struckman et al.
4,257,650 A 3/1981 Allen
4,265,485 A 5/1981 Boxerman et al.
4,278,277 A 7/1981 Krijgsman
4,283,088 A 8/1981 Tabakov et al.
4,287,952 A 9/1981 Erbstoesser
4,390,067 A 6/1983 Willman
4,398,898 A 8/1983 Odom
4,410,216 A 10/1983 Allen
4,415,205 A 11/1983 Rehm et al.
4,434,849 A 3/1984 Allen
4,463,988 A 8/1984 Bouck et al.
4,484,641 A 11/1984 Dismukes
4,491,186 A 1/1985 Alder
4,497,714 A 2/1985 Harris
4,512,403 A 4/1985 Santangelo et al.
4,552,218 A 11/1985 Ross et al.
4,552,230 A 11/1985 Anderson et al.
4,572,295 A 2/1986 Walley
4,576,404 A 3/1986 Weber
4,577,691 A 3/1986 Huang et al.
4,614,303 A 9/1986 Moseley, Jr. et al.
4,649,996 A 3/1987 Kojicic et al.
4,817,710 A 4/1989 Edwards et al.
4,821,800 A 4/1989 Scott et al.
4,856,590 A 8/1989 Caillier
4,899,835 A 2/1990 Cherrington
4,917,183 A 4/1990 Gaidry et al.
4,944,349 A 7/1990 Von Gonten, Jr.
4,974,674 A 12/1990 Wells
4,997,037 A 3/1991 Coston
4,998,585 A 3/1991 Newcomer et al.
5,004,049 A 4/1991 Arterbury
5,016,710 A 5/1991 Renard et al.
5,040,283 A 8/1991 Pelgrom
5,060,737 A 10/1991 Mohn
5,107,927 A 4/1992 Whiteley et al.
5,132,903 A 7/1992 Sinclair
5,156,811 A 10/1992 White
5,188,191 A 2/1993 Tomek
5,217,076 A 6/1993 Masek
5,333,684 A 8/1994 Walter et al.
5,337,821 A 8/1994 Peterson
5,339,895 A 8/1994 Arterbury et al.
5,339,897 A 8/1994 Leaute
5,355,956 A 10/1994 Restarick
5,377,750 A 1/1995 Arterbury et al.
5,381,864 A 1/1995 Nguyen et al.
5,384,046 A 1/1995 Lotter et al.
5,431,346 A 7/1995 Sinaisky
5,435,393 A 7/1995 Brekke et al.
5,435,395 A 7/1995 Connell
5,439,966 A 8/1995 Graham et al.
5,511,616 A 4/1996 Bert
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols et al.
5,829,520 A 11/1998 Johnson
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,944,446 A 8/1999 Hocking
5,982,801 A 11/1999 Deak
6,044,869 A 4/2000 Koob
6,068,015 A 5/2000 Pringle
6,098,020 A 8/2000 Den Boer
6,112,815 A 9/2000 Bøe et al.
6,112,817 A 9/2000 Voll et al.
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron et al.
6,301,959 B1 * 10/2001 Hrametz et al. ..... 73/152.23
6,305,470 B1 10/2001 Woie
6,325,152 B1 12/2001 Kelley et al.
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,530,431 B1 3/2003 Castano-Mears et al.
6,561,732 B1 5/2003 Bloomfield et al.
6,581,681 B1 6/2003 Zimmerman et al.
6,581,682 B1 6/2003 Parent et al.
6,622,794 B2 9/2003 Zisk, Jr.
6,632,527 B1 10/2003 McDaniel et al.
6,635,732 B2 10/2003 Mentak
6,667,029 B2 12/2003 Zhong et al.
6,679,324 B2 1/2004 Den Boer et al.
6,692,766 B1 2/2004 Rubinstein et al.
6,699,503 B1 3/2004 Sako et al.
6,699,611 B2 3/2004 Kim et al.
6,712,154 B2 3/2004 Cook et al.
6,722,437 B2 4/2004 Vercaemer et al.
6,786,285 B2 9/2004 Johnson et al.
6,817,416 B2 11/2004 Wilson et al.
6,820,690 B2 11/2004 Vercaemer et al.
6,830,104 B2 12/2004 Nguyen et al.
6,831,044 B2 12/2004 Constien
6,840,321 B2 1/2005 Restarick et al.
6,857,476 B2 2/2005 Richards
6,863,126 B2 3/2005 McGlothen et al.
6,896,049 B2 5/2005 Moyes
6,913,079 B2 7/2005 Tubel
6,938,698 B2 9/2005 Coronado
6,951,252 B2 10/2005 Restarick et al.
6,959,764 B2 11/2005 Preston
6,976,542 B2 12/2005 Henriksen et al.
7,011,076 B1 3/2006 Weldon et al.
7,032,675 B2 4/2006 Steele et al.
7,059,410 B2 6/2006 Bousche et al.
7,084,094 B2 8/2006 Gunn et al.
7,159,656 B2 1/2007 Eoff et al.
7,185,706 B2 3/2007 Freyer
7,207,385 B2 4/2007 Smith et al.
7,252,162 B2 8/2007 Akinlade et al.
7,258,166 B2 8/2007 Russell
7,264,047 B2 9/2007 Brezinski et al.
7,290,606 B2 11/2007 Coronado et al.
7,290,610 B2 11/2007 Corbett et al.
7,318,472 B2 1/2008 Smith
7,322,412 B2 1/2008 Badalamenti et al.
7,325,616 B2 2/2008 Lopez de Cardenas et al.
7,360,593 B2 4/2008 Constien
7,367,399 B2 5/2008 Steele et al.
7,395,858 B2 7/2008 Barbosa et al.
7,398,822 B2 7/2008 Meijer et al.
7,409,999 B2 8/2008 Henriksen et al.

| | | | |
|---|---|---|---|
| 7,413,022 | B2 | 8/2008 | Broome et al. |
| 7,451,814 | B2 | 11/2008 | Graham et al. |
| 7,469,743 | B2 | 12/2008 | Richards |
| 7,581,593 | B2 | 9/2009 | Pankratz et al. |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 7,757,757 | B1 | 7/2010 | Vroblesky |
| 7,931,081 | B2 | 4/2011 | Sponchia |
| 2002/0020527 | A1 | 2/2002 | Kilaas |
| 2002/0125009 | A1 | 9/2002 | Wetzel et al. |
| 2002/0148610 | A1 | 10/2002 | Bussear et al. |
| 2002/0170717 | A1 | 11/2002 | Venning et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0094307 | A1 | 5/2004 | Daling et al. |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2004/0244988 | A1 | 12/2004 | Preston |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2005/0274515 | A1 | 12/2005 | Smith et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0045266 | A1 | 3/2007 | Sandberg et al. |
| 2007/0056729 | A1 | 3/2007 | Pankratz et al. |
| 2007/0131434 | A1 | 6/2007 | MacDougall et al. |
| 2007/0181299 | A1 | 8/2007 | Chung et al. |
| 2007/0209799 | A1 | 9/2007 | Vinegar et al. |
| 2007/0246210 | A1 | 10/2007 | Richards |
| 2007/0246213 | A1 | 10/2007 | Hailey, Jr. |
| 2007/0246225 | A1 | 10/2007 | Hailey, Jr. et al. |
| 2007/0246407 | A1 | 10/2007 | Richards et al. |
| 2007/0272408 | A1 | 11/2007 | Zazaovsky et al. |
| 2007/0289749 | A1 | 12/2007 | Wood et al. |
| 2008/0035349 | A1 | 2/2008 | Bennett |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0251255 | A1 | 10/2008 | Forbes et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0071646 | A1 | 3/2009 | Pankratz et al. |
| 2009/0101330 | A1 | 4/2009 | Johnson |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0301704 | A1 | 12/2009 | Dillett et al. |
| 2010/0038086 | A1* | 2/2010 | Bunnell et al. ..... 166/300 |
| 2010/0126720 | A1 | 5/2010 | Kaiser et al. |

FOREIGN PATENT DOCUMENTS

| | | | |
|---|---|---|---|
| GB | 1492345 | | 6/1976 |
| GB | 2341405 | | 3/2000 |
| JP | 59089383 | | 5/1984 |
| SU | 1335677 | | 8/1985 |
| WO | 9403743 | | 2/1994 |
| WO | 0079097 | | 12/2000 |
| WO | 0165063 | | 9/2001 |
| WO | 0177485 | | 10/2001 |
| WO | 0192681 | A1 | 12/2001 |
| WO | 02075110 | | 9/2002 |
| WO | 2004018833 | A1 | 3/2004 |
| WO | 2006015277 | | 2/2006 |
| WO | 2008092241 | A1 | 8/2008 |

OTHER PUBLICATIONS

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 595.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.

Hackworth, et al. "Development and First Application of Bistable Expandable Sand Screen," Society of Petroleum Engineers: SPE 84265. Oct. 5-8, 2003. 14 pages.

Henry Restarick, "Horizontal Completion Options in Reservoirs with Sand Problems". SPE 29831. Mar. 11-14, 1995. pp. 545-560.

Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.

Mathis, Stephen P. "Sand Management: A Review of Approaches and Conerns," SPE 82240, The Hague, The Netherlands, May 13-14, 2003. 7 pages.

Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
Tanaka, T., Ricka, J., (1984) Swelling of Ionic gels: Quantitative performance of the Donnan Thory, Macromolecules, 17, 2916-2921.
Tanaka, T., Nishio, I., Sun, S.T., Uena-Nisho, S. (1982) Collapse of gels in an electric field, Science, 218-467-469.
Notification of Transmittal of the International Search Report and the Written Opinion of the International Searching Authority; PCT Application No. PCT/US2010/034747; Mailed Dec. 13, 2010; Korean Intellectualy Property Office.
International Search Report; Date of Mailing Jan. 27, 2011; International Application No. PCT/US2010/034752; 3 Pages.
International Search Report and Written Opinion; Date of Mailing Jan. 13, 2011; International Appln No. PCT/US2010/034750; International Search Report 5 Pages; Written Opinion 3 Pages.
International Search Report and Written Opinion; Date of Mailing Jan. 27, 2011, International Appln No. PCT/US2010/034758; International Search Report 10 Pages; Written Opinion 3 Pages.
Mackenzie, Gordon Adn Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.
Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/30574t-ttintervention_catalog-1110.pdf.pdf&fs=4460520, 2010 pp. 79-81.

* cited by examiner

PERMEABILITY FLOW BALANCING WITHIN INTEGRAL SCREEN JOINTS

BACKGROUND

Viscous hydrocarbon recovery is a segment of the overall hydrocarbon recovery industry that is increasingly important from the standpoint of global hydrocarbon reserves and associated product cost. In view hereof, there is increasing pressure to develop new technologies capable of producing viscous reserves economically and efficiently. Steam Assisted Gravity Drainage (SAGD) is one technology that is being used and explored with good results in some wellbore systems. Other wellbore systems however where there is a significant horizontal or near horizontal length of the wellbore system present profile challenges both for heat distribution and for production. In some cases, similar issues arise even in vertical systems.

Both inflow and outflow profiles (e.g. production and stimulation) are desired to be as uniform as possible relative to the particular borehole. This should enhance efficiency as well as avoid early water breakthrough. Breakthrough is clearly inefficient as hydrocarbon material is likely to be left in situ rather than being produced. Profiles are important in all well types but it will be understood that the more viscous the target material the greater the difficulty in maintaining a uniform profile.

Another issue in conjunction with SAGD systems is that the heat of steam injected to facilitate hydrocarbon recovery is sufficient to damage downhole components due to thermal expansion of the components. This can increase expenses to operators and reduce recovery of target fluids. Since viscous hydrocarbon reserves are likely to become only more important as other resources become depleted, configurations and methods that improve recovery of viscous hydrocarbons from earth formations will continue to be well received by the art.

SUMMARY

A SAGD system in a formation including a heated fluid injection well having a tubular including permeability control, one or more open hole anchors restricting thermal growth of the tubular and one or more baffles directing heated fluid application to target areas of the formation; and a production well in fluid collecting proximity to the injection well the production well having a tubular with permeability control, one or more open hole anchors and one or more baffles.

BRIEF DESCRIPTION OF THE DRAWINGS

Referring now to the drawings wherein like elements are numbered alike in the several figures.

DETAILED DESCRIPTION

Figure 1:
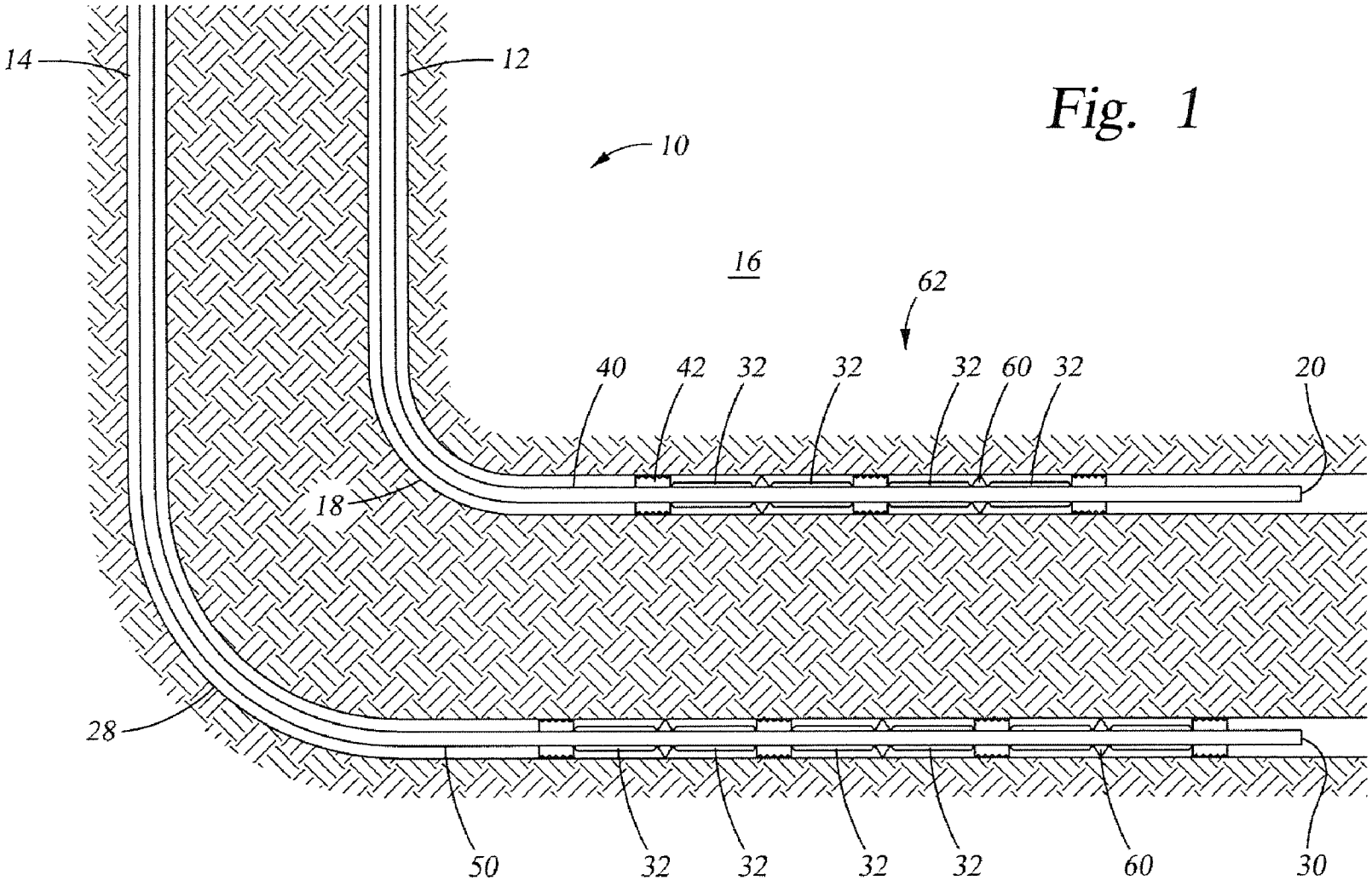
FIG. 1 is a schematic view of a wellbore system in a viscous hydrocarbon reservoir.

Referring to FIG. 1, the reader will recognize a schematic illustration of a portion of a SAGD wellbore system 10 configured with a pair of boreholes 12 and 14. Generally, borehole 12 is the steam injection borehole and borehole 14 is the hydrocarbon recovery borehole but the disclosure should not be understood as limiting the possibilities to such. The discussion herein however will address the boreholes as illustrated. Steam injected in borehole 12 heats the surrounding formation 16 thereby reducing the viscosity of the stored hydrocarbons and facilitating gravity drainage of those hydrocarbons. Horizontal or other highly deviated well structures like those depicted tend to have greater fluid movement into and to of the formation at a heel 18 of the borehole than at a toe 20 of the borehole due simply to fluid dynamics. An issue associated with this property is that the toe 20 will suffer reduced steam application from that desired while heel 18 will experience more steam application than that desired, for example. The change in the rate of fluid movement is relatively linear (declining flow) when querying the system at intervals with increasing distance from the heel 18 toward the toe 20. The same is true for production fluid movement whereby the heel 28 of the production borehole 14 will pass more of the target hydrocarbon fluid than the toe 30 of the production borehole 14. This is due primarily to permeability versus pressure drop along the length of the borehole 12 or 14. The system 10 as illustrated alleviates this issue as well as others noted above.

Figure 2:
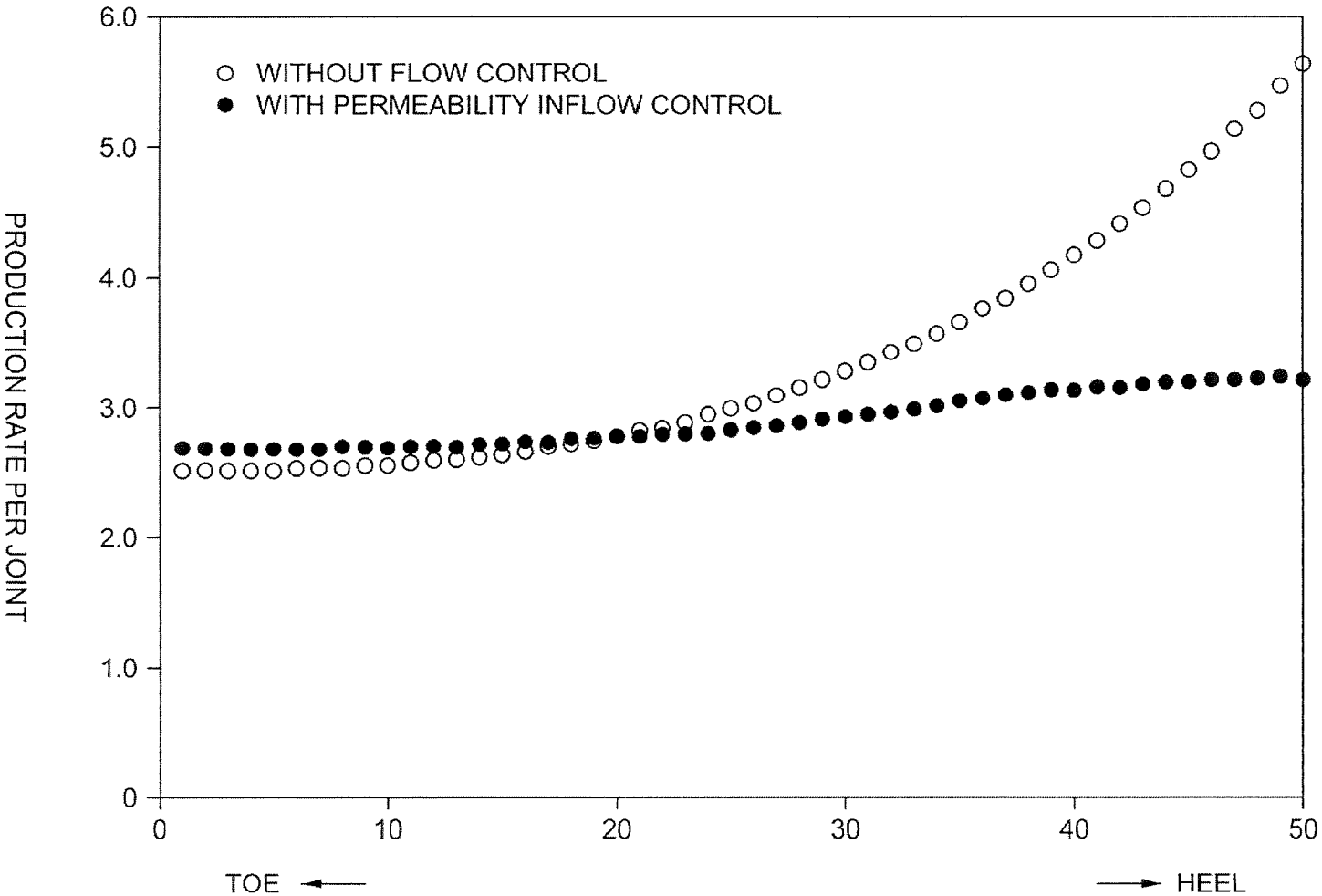
FIG. 2 is a chart illustrating a change in fluid profile over a length of the borehole with and without permeability control.

According to the teaching herein, one or more of the boreholes (represented by just two boreholes 12 and 14 for simplicity in illustration) is configured with one or more permeability control devices 32 that are each configured differently with respect to permeability or pressure drop in flow direction in or out of the tubular. The devices 32 nearest the heel 18 or 28 will have the least permeability while permeability will increase in each device 32 sequentially toward the toe 20 and 30. The permeability of the device 32 closest to toe 20 or 30 will be the greatest. This will tend to balance outflow of injected fluid and inflow of production fluid over the length of the borehole 12 and 14 because the natural pressure drop of the system is opposite that created by the configuration of permeability devices as described. Permeability and/or pressure drop devices 32 useable in this configuration include inflow control devices such as product family number H48688 commercially available from Baker Oil Tools, Houston Tex., beaded matrix flow control configurations such as those disclosed in U.S. Ser. No. 61/052,919, expired on May 13, 2009, U.S. Pat. No. 7,918,272 and U.S. Pat. Nos. 7,775,277, 7,789,139 and 7,784,543 the disclosures of which are incorporated herein by reference, or other similar devices. Adjustment of pressure drop across individual permeability devices is possible in accordance with the teaching hereof such that the desired permeability over the length of the borehole 12 or 14 as described herein is achievable. Referring to FIG. 2, a chart of the flow of fluid over the length of borehole 12 is shown without permeability control and with permeability control. The representation is stark with regard to the profile improvement with permeability control.

In order to determine the appropriate amount of permeability for particular sections of the borehole 12 or 14, one needs to determine the pressure in the formation over the length of the horizontal borehole. Formation pressure can be determined/measured in a number of known ways. Pressure at the heel of the borehole and pressure at the toe should also be determined/measured. This can be determined in known ways. Once both formation pressure and pressures at locations within the borehole have been ascertained, the change in pressure ($\Delta P$) across the completion can be determined for each location where pressure within the completion has been or is tested. Mathematically this is expressed as $\Delta P$ location=P formation−P location where the locations may be the heel, the toe or any other point of interest.

Figure 3:
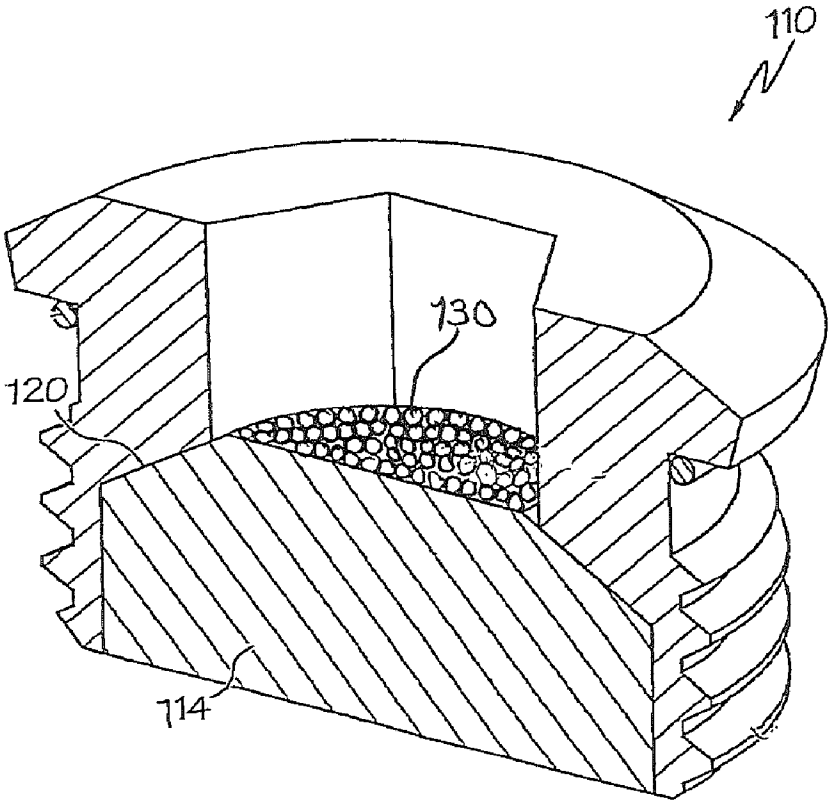
FIG. 3 is a perspective sectional view of a beaded matrix type permeability control device.

A flow profile whether into or out of the completion is dictated by the ΔP at each location and the pressure inside the completion is dictated by the head of pressure associated with the column of fluid extending to the surface. The longer the column, the higher the pressure. It follows, then, that greater resistance to inflow will occur at the toe of the borehole than at the heel of the completion. In accordance with the teaching hereof permeability control is distributed such that pressure drop at a toe of the borehole is in the range of about 25% to less than 1% whereas pressure drop at the heel of the borehole is about 30% or more. In one embodiment the pressure drop at the heel is less than 45% and at the toe less than about 25%. Permeability control devices distributed between the heel and the toe will in some embodiments have individual pressure drop values between the percentage pressure drop at the toe and the percentage pressure drop at the heel. Moreover, in some embodiments the distribution of pressure drops among the permeability devices is linear while in other embodiments the distribution may follow a curve or may be discontinuous to promote inflow of fluid from areas of the formation having larger volumes of desirable liberatable fluid and reduced inflow of fluid from areas of the formation having smaller volumes of desirable liberatable fluid. In one embodiment, referring to FIG. 3, the permeability control devices 110 comprise a bore disposed longitudinally through the device is of more than one diameter (or dimension if not cylindrical). This creates a shoulder 120 within the inside surface of the device 110. While it is not necessarily required to provide the shoulder 120, it can be useful in applications where the device is rendered temporarily impermeable and might experience differential pressure thereacross.

The matrix itself is described as "beaded" since the individual "beads" 130 are rounded though not necessarily spherical. A rounded geometry is useful primarily in avoiding clogging of the matrix 114 since there are few edges upon which debris can gain purchase.

The beads 130 themselves can be formed of many materials such as ceramic, glass, metal, etc. without departing from the scope of the disclosure. Each of the materials indicated as examples, and others, has its own properties with respect to resistance to conditions in the downhole environment and so may be selected to support the purposes to which the devices 110 will be put. The beads 130 may then be joined together (such as by sintering, for example) to form a mass (the matrix 114) such that interstitial spaces are formed therebetween providing the permeability thereof. In some embodiments, the beads will be coated with another material for various chemical and/or mechanical resistance reasons. One embodiment utilizes nickel as a coating material for excellent wear resistance and avoidance of clogging of the matrix 114. Further, permeability of the matrix tends to be substantially better than a gravel or sand pack and therefore pressure drop across the matrix 114 is less than the mentioned constructions. In another embodiment, the beads are coated with a highly hydrophobic coating that works to exclude water in fluids passing through the device 110. In addition to coatings or treatments that provide activity related to fluids flowing through the matrix 114, other materials may be applied to the matrix 114 to render the same temporarily (or permanently if desired) impermeable.

Each or any number of the devices 110 can easily be modified to be temporarily (or permanently) impermeable by injecting a hardenable (or other property causing impermeability) substance such as a bio-polymer into the interstices of the beaded matrix 114. Determination of the material to be used is related to temperature and length of time for undermining (dissolving, disintegrating, fluidizing, subliming, etc) of the material desired. For example, Polyethylene Oxide (PEO) is appropriate for temperatures up to about 200 degrees Fahrenheit, Polywax for temperatures up to about 180 degrees Fahrenheit; PEO/Polyvinyl Alcohol (PVA) for temperatures up to about 250 degrees Fahrenheit; Polylactic Acid (PLA) for temperatures above 250 degrees Fahrenheit; among others. These can be dissolved using acids such as Sulfamic Acid, Glucono delta lactone, Polyglycolic Acid, or simply by exposure to the downhole environment for a selected period, for example. In one embodiment, Polyvinyl Chloride (PVC) is rendered molten or at least relatively soft and injected into the interstices of the beaded matrix and allowed to cool. This can be accomplished at a manufacturing location or at another controlled location such as on the rig. It is also possible to treat the devices in the downhole environment by pumping the hardenable material into the devices in situ. This can be done selectively or collectively of the devices 110 and depending upon the material selected to reside in the interstices of the devices; it can be rendered soft enough to be pumped directly from the surface or other remote location or can be supplied via a tool run to the vicinity of the devices and having the capability of heating the material adjacent the devices. In either case, the material is then applied to the devices. In such condition, the device 110 will hold a substantial pressure differential that may exceed 10,000 PSI.

The PVC, PEO, PVA, etc. can then be removed from the matrix 114 by application of an appropriate acid or over time as selected. As the hardenable material is undermined, target fluids begin to flow through the devices 100 into a tubular in which the devices 110 are mounted. Treating of the hardenable substance may be general or selective. Selective treatment is by, for example, spot treating, which is a process known to the industry and does not require specific disclosure with respect to how it is accomplished.

Referring back to FIG. 1, a tubing string 40 and 50 are illustrated in boreholes 12 and 14 respectively. Open hole anchors 42, such as Baker Oil Tools WBAnchor™ may be employed in the borehole to anchor the tubing 40. This is helpful in that the tubing 40 experiences a significant change in thermal load and hence a significant amount of thermal expansion during well operations. Unchecked, the thermal expansion can cause damage to other downhole structures or to the tubing string 40 itself thereby affecting efficiency and production of the well system. In order to overcome this problem, one or more open hole anchors 42 are used to ensure that the tubing string 40 is restrained from excessive movement. Because the total length of mobile tubing string is reduced by the interposition of open hole anchor(s) 42, excess extension cannot occur. In one embodiment, three open hole anchors 42, as illustrated, are employed and are spaced by about 90 to 120 ft from one another but could in some particular applications be positioned more closely and even every 30 feet (at each pipe joint). The spacing interval is also applicable to longer runs with each open hole anchor being spaced about 90-120 ft from the next. Moreover, the exact spacing amount between anchors is not limited to that noted in this illustrated embodiment but rather can be any distance that will have the desired effect of reducing thermal expansion related wellbore damage. In addition the spacing can be even or uneven as desired. The determination of distance between anchors must take into account. The anchor length, pattern, or the number of anchor points per foot in order to adjust the anchoring effect to optimize performance based on formation type and formation strength tubular dimensions and material.

Finally in one embodiment, the tubing string 40, 50 or both is configured with one or more baffles 60. Baffles 60 are effective in both deterring loss of steam to formation cracks such as that illustrated in FIG. 1 as numeral 62 and in causing produced fluid to migrate through the intended permeability device 32. More specifically, and taking the functions one at a time, the injector borehole, such as 12, is provided with one or more baffles 60. The baffles may be of any material having the ability to withstand the temperature at which the particular steam is injected into the formation. As shown in FIG. 1, the baffles 60 may include a substantially pointed cross-section tapered to a substantially pointed end where the pointed end is radially extended to contact the formation. In one embodiment, a metal deformable seal such as one commercially known as a z-seal and available from Baker Oil Tools, Houston Tex., may be employed. And while metal deformable seals are normally intended to create a high pressure high temperature seal against a metal casing within which the seal is deployed, for the purposes taught in this disclosure, it is not necessary for the metal deformable seal to create an actual seal. That stated however, there is also no prohibition to the creation of a seal but rather then focus is upon the ability of the configuration to direct steam flow with relatively minimal leakage. In the event that an actual seal is created with the open hole formation, the intent to minimize leakage will of course be met. In the event that a seal is not created but substantially all of the steam applied to a particular region of the wellbore is delivered to that portion of the formation then the baffle will have done its job and achieved this portion of the intent of this disclosure. With respect to production, the baffles are also of use in that the drawdown of individual portions of the well can be balanced better with the baffles so that fluids from a particular area are delivered to the borehole in that area and fluids from other areas do not migrate in the annulus to the same section of the borehole but rather will enter at their respective locations. This ensures that profile control is maintained and also that where breakthrough does occur, a particular section of the borehole can be bridged and the rest will still produce target fluid as opposed to breakthrough fluid since annular flow will be inhibited by the baffles. In one embodiment baffles are placed about 100 ft or 3 liner joints apart but as noted with respect to the open hole anchors, this distance is not fixed but may be varied to fit the particular needs of the well at issue. The distance between baffles may be even or may be uneven and in some cases the baffles will be distributed as dictated by formation condition such that for example cracks in the formation will be taken into account so that a baffle will be positioned on each side of the crack when considered along the length of the tubular.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A steam assisted gravity drainage system in a formation comprising:

a heated fluid injection well having a tubular including permeability control, one or more open hole anchors restricting thermal growth of the tubular and one or more baffles directing heated fluid application to target areas of the formation; and a production well in fluid collecting proximity to the injection well the production well having a tubular with permeability control, one or more open hole anchors and one or more baffles;

wherein the one or more baffles of at least one of the injection well and the production well are open hole baffles having a tapered cross-section including a substantially pointed end contacting the formation.

2. A steam assisted gravity drainage system as claimed in claim 1 wherein the tubular in the injection well is permeability controlled to have lesser permeability at a heel of the tubular and more permeability at a toe of the tubular.

3. A steam assisted gravity drainage system as claimed in claim 1 wherein the tubular in the production well is permeability controlled to have lesser permeability at a heel of the tubular and more permeability at a toe of the tubular.

4. A steam assisted gravity drainage system as claimed in claim 1 wherein the injection well has lower permeability toward a heel of the injection well and relatively more permeability toward a toe of the injection well.

5. A steam assisted gravity drainage system as claimed in claim 4 wherein the permeability control is one or more permeability control devices.

6. A steam assisted gravity drainage system as claimed in claim 5 wherein the one or more devices are beaded matrixes.

7. A steam assisted gravity drainage system as claimed in claim 4 wherein the one or more baffles in at least one of the injection well and production well are metal.

8. A steam assisted gravity drainage system as claimed in claim 1 wherein the production well has lower permeability toward a heel of the production well and relatively more permeability toward a toe of the production well.

9. A steam assisted gravity drainage system as claimed in claim 8 wherein the permeability control is one or more permeability control devices.

10. A steam assisted gravity drainage system as claimed in claim 8 wherein the one or more devices are beaded matrixes.

11. A steam assisted gravity drainage system as claimed in claim 8 wherein the one or more baffles in at least one of the injection well and the production well are metal.

12. A steam assisted gravity drainage system as claimed in claim 1 wherein the one or more baffles in at least one of the injection well and the production well are metal.

* * * * *